United States Patent [19]

Strauss et al.

[11] 4,434,582

[45] Mar. 6, 1984

[54] GLASS TRIMMING CUTTER WITH ROLLER CONVEYOR

[75] Inventors: Gottfried Strauss, Heiligenhaus; Horst Schumann, Ratingen, both of Fed. Rep. of Germany

[73] Assignee: Sack Glastechnik GmbH, Düsseldorf, Fed. Rep. of Germany

[21] Appl. No.: 203,970

[22] Filed: Nov. 4, 1980

Related U.S. Application Data

[63] Continuation of Ser. No. 967,869, Dec. 8, 1978, abandoned.

[30] Foreign Application Priority Data

Dec. 17, 1977 [DE] Fed. Rep. of Germany ..... 2756443

[51] Int. Cl.[3] ..... B24B 17/02

[52] U.S. Cl. ..... 51/101 R; 51/215 UE

[58] Field of Search ..... 51/101 R, 105 SP, 215 E, 51/215 UE, 423; 225/97–98; 271/194, 267; 414/752

[56] References Cited

U.S. PATENT DOCUMENTS

| | | | |
|---|---|---|---|
| 2,579,337 | 12/1951 | Reaser et al. | 51/101 R |
| 3,418,099 | 12/1968 | Carter et al. | 414/752 |
| 3,532,259 | 10/1970 | Augustin et al. | 225/97 |
| 3,678,628 | 7/1972 | McMaster | 51/101 R |
| 3,693,296 | 9/1972 | Carpenter | 51/423 |
| 3,878,650 | 4/1975 | Klotzbach | 51/101 R |
| 3,934,375 | 1/1976 | Horstein | 51/101 R |
| 3,990,570 | 11/1976 | Mercier et al. | 271/267 |

FOREIGN PATENT DOCUMENTS 1950819 6/1970 Fed. Rep. of Germany .

2349871 7/1977 Fed. Rep. of Germany .

*Primary Examiner*—Harold D. Whitehead

*Attorney, Agent, or Firm*—Toren, McGeady and Stanger

[57] ABSTRACT

A glass trimming cutter for working the edges of glass panes is disclosed. The cutter includes a horizontally arranged, motor-driven rotary table having releasable gripping devices for temporarily securing glass panes in position. One or more peripheral cutting wheels is movably supported at the periphery of the rotary table which wheel is controlled by a template guide. A feed conveyor horizontally supports glass panes to be worked and a discharge conveyor horizontally supports worked glass panes. A loading and unloading device operates automatically in dependence upon the movement of rotation of the table. The loading and unloading device has a support device which can be moved between a first position above the feed conveyor, a second position above the rotary table and a third position above the discharge conveyor. The rotary table has an axis of rotation arranged along longitudinal central planes of the feed conveyor and along longitudinal central planes of the discharge conveyor. The rotary table has a conveyor track which essentially extends across the entire diameter of the rotary table and, in a feed or a discharge position of the rotary table, is in alignment with the feed conveyor and the discharge conveyor. The gripping devices are arranged in the region of the conveyor or track. The support includes a pair of carriages which are suspended from respective conveyor tracks and which are movable between the mentioned positions linear and parallel to the feed conveyor and/or the discharge conveyor.

1 Claim, 3 Drawing Figures

GLASS TRIMMING CUTTER WITH ROLLER CONVEYOR

This is a continuation of application Ser. No. 967,869, filed Dec. 8, 1978, now abondoned.

FIELD OF THE INVENTION

The invention relates to a glass trimming cutter for working the edges of glass panes, having a horizontally arranged, motor-driven rotary table with releasable gripping devices for temporarily securing the glass panes in position, the gripping devices operating automatically in dependence on the movement of the rotary table; at least one peripheral cutting wheel which is movably supported at the circumference of the rotary table and is controlled by a template guide or the like; and a loading and unloading device which operates automatically in dependence on the rotary movement of the rotary table, the loading and unloading device having a support arrangement which has releasable holding devices for the glass panes and can be moved between a first position which is situated vertically above a feed conveyor which horizontally supports the glass panes to be worked, a second position situated vertically above the rotary table, and a third position which is situated vertically above a discharge conveyor or the like which horizontally supports the worked glass panes.

BACKGROUND OF THE INVENTION

It is known to chamfer glass panes, particularly for windshields and rear windows of motor vehicles, at the edges thereby, so that, first, a pane arranged horizontally on a conveyor device, for example, on a roller conveyor, is conveyed to a first cutting or trimming machine. As soon as the pane reaches the region of the first edge cutting machine, it is engaged by guide devices which are arranged, as seen in the conveying direction, on both sides of the cutting machine and is passed alongside of peripheral cutting wheels which are also arranged on each side of the cutting machine and is worked during this procedure. After leaving the first cutting machine, the glass pane is conveyed from the conveying device to a turnstile and is turned by 180° in the turnstile. Subsequently, in this turned position, the pane is conveyed to a second edge cutting machine which corresponds to the first cutting machine and, consequently, the second cutting machine works the longitudinal edges of the glass pane. The peripheral cutting wheels used in both cutting machines have concave peripheral surfaces, as they are known from cutting wheels which are used for cutting C-shaped edges of panes for motor vehicles. In order to facilitate a high throughput and, in addition, to prevent an excessive wear of the expensive peripheral cutting wheels in the above-described edge cutting machine, the edges of the panes are chamfered in such a manner that the C-shape of the peripheral surface of the cutting wheel completely surrounds the entire edge region of the glass pane. The cutting wheel surface comes only into contact with the upper and lower edge of the glass pane and, thus, carries out a chamfering without working the end faces.

Because the end faces are not worked in the known edge cutting machines for chamfering glass panes, a rough surface remains which leads to undesirable hairline fractures during subsequent working steps, for example, during the production of laminated glass panes or particularly also during hardening of the glass panes. These hairline fractures may easily lead to a rupture of the glass panes. In particular, the above-described known edge cutting machine has the disadvantage that, due to a lacking force guidance of the peripheral cutting wheels which are arranged at the sides of the glass panes to be worked and are only loaded by weight or a spring, the corners of the panes which are, as a rule, essentially of rectangular design and have a very small radius of curvature, are worked only insufficiently. This leads to irregularities in the corner region which may later, namely during hardening of the glass panes, lead to cracks and, thus, to phenomena of failure. However, these disadvantages were put up with thus far, since the know double or twin edge cutting machine allows a high throughput. This is so because the glass pane, after cutting the longitudinal edges in the first edge cutting machine, can be conveyed without interruption into the second working station and, simultaneously to this procedure, the first edge cutting machine is loaded with a new pane to be worked. Accordingly, the sequence of conveying is not interrupted at all, not even during the cutting procedure.

On the other hand, from the German Auslegeschrift No. 2,349,871, a glass cutting machine of the above mentioned type is already known which serves particularly for cutting the C-shaped edges of glass panes for side windows and models of motor vehicles. In this case, the loading and unloading device has a support device or girder which is pivotally supported at a swivel arm which also has a rotary drive. At the free end of the girder there is provided a holding device for a glass pane. With respect to the axis of rotation of the rotary table, the swivel arm is arranged coaxially, while the girder is arranged in its center. As a result, the girder has two free ends, at each of which a holding device is arranged. The coaxial arrangement of the axis of rotation of the swivel arm relative to the axis of rotation of the rotary table prevents any relative movement between the holding devices and the gripping devices during loading or unloading.

In principle, the glass cutting or trimming machine according to the German Auslegeschrift No. 2,349,871 has been proven to be quite effective as far as the cutting of the C-shaped edges of relatively small glass panes is concerned. However, it has become apparent that it is difficult to use the known, automatically operating glass cutting machine of the indicated type for chamfering larger glass panes, particularly glass panes for front and rear windows, since the desired high throughput cannot be achieved in this case. This is due to the fact that the panes for front and rear windows have significantly larger dimensions than the panes for side windows of motor vehicles, so that, while maintaining manageable dimensions of the rotary table, it is not possible to simultaneously place two panes on the rotary table and work on them, as it is possible in the case of glass panes for side windows or models. On the contrary, in the known glass cutting machine it is only possible to always place a single front or rear window pane on the rotary table, so that significant time losses occur when the known glass cutting machine is used with the loading and unloading devices provided for this machine. These time losses inevitably lead to an accumulation when the conveying sequence remains unchanged. When front or rear window panes are cut or chamfered, by means of the loading and unloading device of the glass cutting machine according to the German Auslegeschrift No. 2,349,871, it is not possible at all to simultaneously place a new glass pane on the rotary table and to discharge an already worked pane.

SUMMARY OF THE INVENTION

The invention, therefore, is directed toward the provision of a glass trimming cutter of the indicated type to the extent that, without significant reduction in throughput compared to the known twin edge cutting machines, it can also be used for chamfering larger glass panes, particularly the glass panes for front and rear windows of motor vehicles, with a significant increase in the cutting quality.

A glass trimming cutter for working the edges of glass panes comprises, in acordance with the present invention, a horizontally arranged, motor-driven rotary table having releasable gripping devices for temporarily securing glass panes in position, the gripping devices operating automatically in dependence upon the movement of the rotary table. Also included are at least one peripheral cutting wheel which is movably supported at the periphery of the rotary table, a template guide for controlling the cutting wheel, a feed conveyor which horizontally supports glass panes to be worked and a discharge conveyor which horizontally supports worked glass panes. Further included is a loading and unloading device which operates automatically in dependence upon the movement of rotation of the rotary table. The loading and unloading device has a support device which can be moved between a first position situated vertically above the feed conveyor, a second position situated vertically above the rotary table and a third position situated vertically above the discharge conveyor. The support device has releasable holding devices for the glass panes. The rotary table has an axis of rotation which is arranged along longitudinal central planes of the feed conveyor and along longitudinal central planes of the discharge conveyor. The rotary table also has a conveyor track which essentially extends across the entire diameter of the rotary table and, in a feed or discharge position of the rotary table, is in alignment with the feed conveyor and the discharge conveyor. The gripping devices are arranged in the region of the conveyor track. The support device also has at least one carriage which is supported from a conveyor or track and can be moved between the position linear with and parallel to the feed conveyor or discharge conveyor.

For a better understanding of the present invention, reference is made to the following description and accompanying drawings, while the scope of the present invention will be pointed out in the appended claims.

DESCRIPTION OF THE PREFERRED EMBODIMENTS

Figure 1:
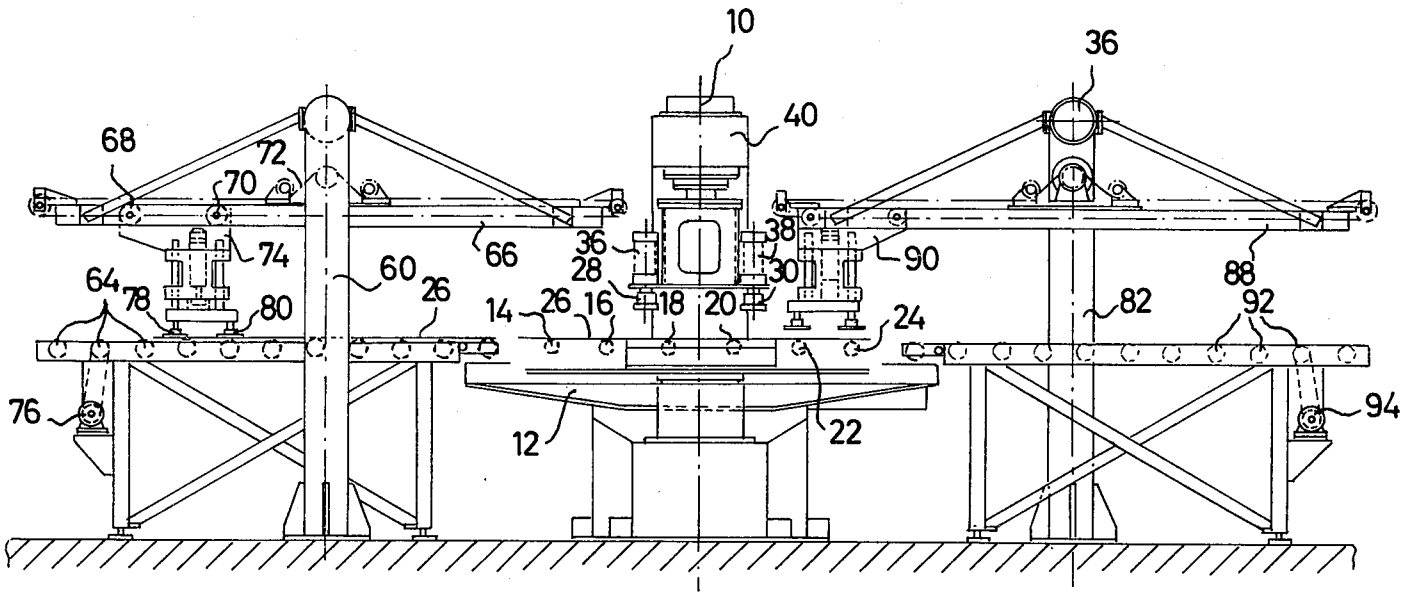
FIG. 1 shows a side view of a glass cutting machine according to the invention.
Figure 2:
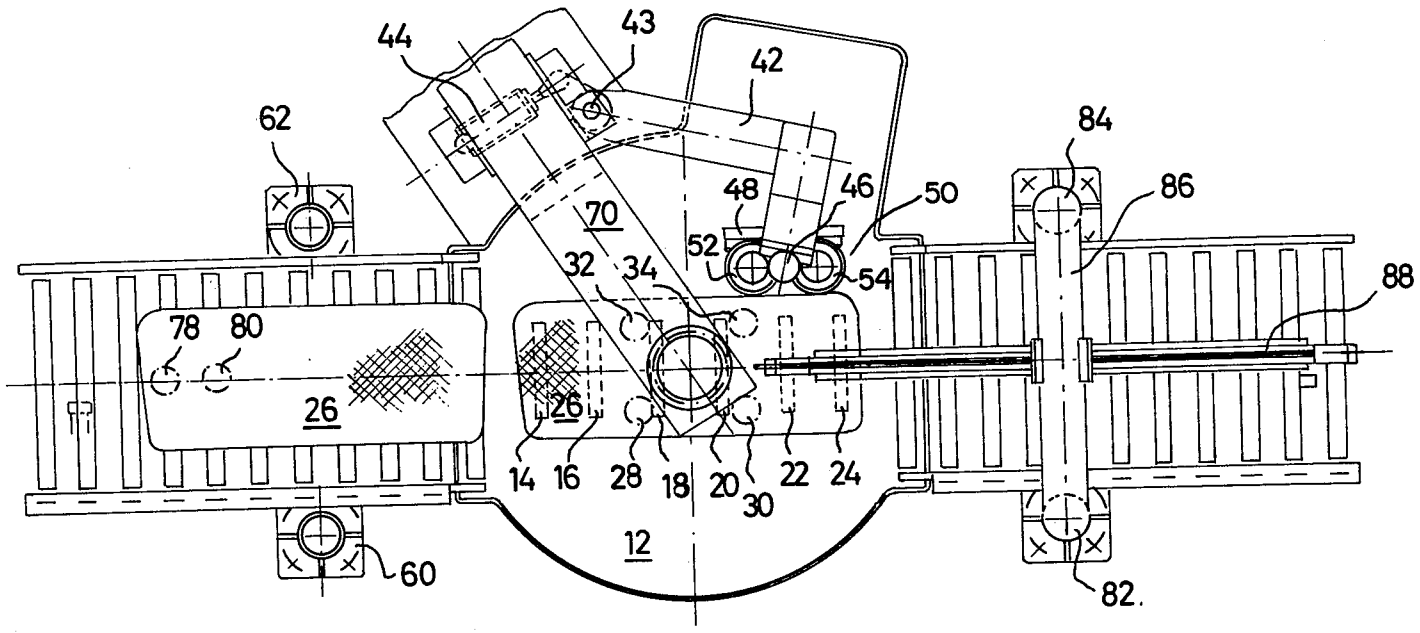
FIG. 2 shows a top view of the glass cutting machine shown in FIG. 1.

As FIGS. 1 and 2 show, the embodiment of the glass cutting machine according to the invention shown in the drawing has a rotary table 12 which is arranged with a vertical axis of rotation 10. Through a gearing (not shown), the rotary table 12 is driven by a direct-current motor with speed regulation (also not shown). In the manner shown in FIG. 2, a conveyor track consisting of conveying rollers 14, 16, 18, 20, 22 and 24 extends essentially over the entire diameter of the rotary table 12. The conveying rollers 14 to 24 are not driven, but are arranged loosely.

In the manner shown in FIGS. 1 and 2, there rests a glass pane 26 to be worked on the coveying rollers. From the upper position shown in FIG. 1, four suction cups 28, 30, 32, 34 which serve as gripping devices and to which a partial vacuum can be applied can be lowered onto the glass pane 26. Together with the piston-cylinder units 36, 38, the suction cups 28 to 34 are arranged at a support arm 40 which cantilevers over the rotary table 12 from the periphery of the rotary table. The piston-cylinder units 36, 38 automatically control the suction cups 28 to 34. As FIG. 2 further shows, at the end of an angular swinging lever 42, two peripheral cutting wheels 48, 50 are arranged through a joint swivel bearing 46. The swinging lever 42 can be swung horizontally about a point of rotation 43 and, for example, by means of a compressed-air cylinder 44, is pulled in the direction toward the axis of rotation 10. The piston-cylinder units 36, 38 are preferably also actuated by compressed air.

During rotation of the rotary table 12, the motor speed or the speed of rotation of the rotary table 12 are, for example, controlled by means of a potentiometer control in such a manner that the feed velocity relative to the pane edges to be worked is kept as constant as possible during cutting of the glass pane 26 while taking into consideration the various distances from the peripheral cutting wheels 48, 50. When sharp corners are being cut, the speed of rotation can additionally be reduced accordingly. Due to the action of the compressed-air cylinder 44, the guide rollers 52, 54 (FIG. 3) arranged coaxially relative to the peripheral cutting wheels 48, 50, rest against a template 56 which is of known design and can be exchanged depending on the shape of the pane. During the rotation of the rotary table 12, the guide rollers 52, 54 guide the peripheral cutting wheels in accordance with the template, so that the edge of the glass pane 26 to be worked is chamfered in the desired shape.

Figure 3:
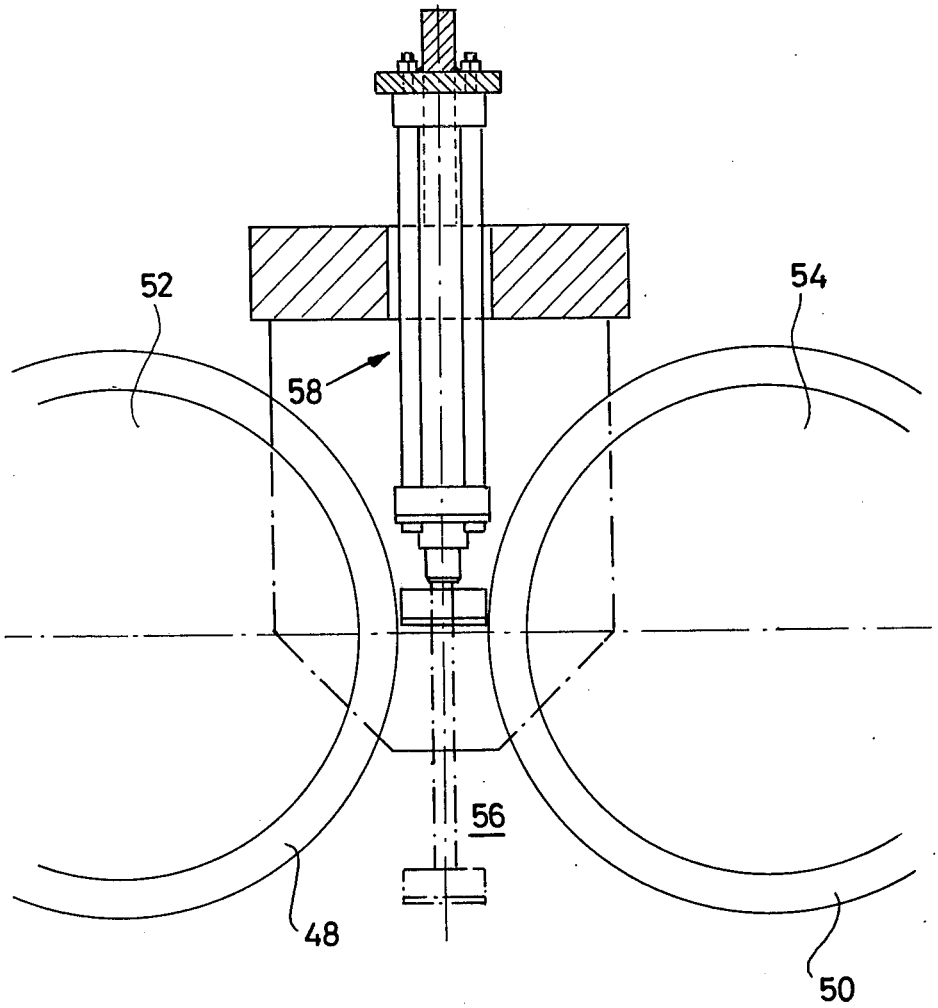
FIG. 3 shows a top view, partially in section and in an enlarged scale, of the device for disengaging the peripheral cutting wheels of the glass cutting machine shown in FIGS. 1 and 2.

From the detailed representation of FIG. 3, it can be seen that the peripheral cutting wheels 48, 50 can be disengaged from their working positions into a waiting position through a compressed-air actuated piston-cylinder unit which, in its totality, is denoted by reference numeral 58. The stroke of the piston-cylinder unit 58 is preferably about 10 to 15 mm. The disengagement of the peripheral cutting wheels 48, 50 from the working position shown in FIG. 2 in which the peripheral cutting wheels 48, 50 work on the pane 26 takes place transversely to the direction of conveying. Accordingly, disengagement takes place in such a manner that the peripheral cutting wheels no longer have contact with the edge of the glass pane 26. The purpose of this measure shall be explained below.

As FIGS. 1 and 2 show, the glass cutting machine according to the invention has a conveyor track section 66 which is provided with U-sections in which there is supported a feed carriage 74 which can be moved linearly to and fro by means of a rope drive 72 on wheels 68, 70. The conveyor track section 66 is supported by two upright supports 60, 62 which are arranged on both sides of a feed roller conveyor which is formed by a plurality of conveying rollers 64. In the manner shown in FIGS. 1 and 2, the feed carriage 74 has two suction cups 78, 80 which are arranged, seen in the direction of conveying, one behind the other.

In the manner shown in FIG. 1, the suction cups 78, 80 can be lowered onto a glass pane 26 to be worked which has been delivered by the feed conveyor 64 whose individual conveying rollers 64 can be driven by a motor 76. As FIG. 1 shows, the conveyor track section 66 extends over the feed conveyor 64 to such an extent that the carriage 74, in its final position facing away from the rotary table 12, is arranged above that end region of the glass pane 26 delivered by the feed conveyor 64 which is facing away from the rotary table 12. On the other hand, the conveyor track section 66 cantilevers over the rotary table 12 to such an extent that the feed carriage 74, in its end position facing toward the rotary table, is arranged above the conveyor track formed by the conveying rollers 14 to 24. The purpose of this measure shall now be explained.

As FIGS. 1 and 2 show, on the discharge side of the rotary table 12, as on the feed side, there are arranged two upright supports 82, 84 which support a discharge conveyor track section 88 through a transverse girder 86. Along the discharge conveyor track section 88, a discharge carriage 90 can be moved to and fro whose design, structure and arrangement otherwise completely correspond to those of the arrangement on the feed side. Accordingly, it is not necessary to provide further explanation on this point. Moreover, the conveying rollers 92 of a discharge roller conveyor corresponding to the conveying rollers 64 of the feed conveyor can be driven and also controlled by their own drive motor 94.

The glass cutting machine according to the invention operates as follows:

First, a glass pane 26, lying on the conveying rollers 64 of the feed conveyor driven by the motor 76 in this stage of operation, is moved into the position shown in FIG. 1 on the left-hand side where, accordingly, the front edge of the glass pane to be worked lies in the vicinity of that end of the feed conveyor 64 which is on the side of the rotary table, and the rear edge of the glass pane 26 lies in the vicinity of the rearward end of the conveyor track section 66. Accordingly, in its rearward end position shown on the left-hand side of FIG. 1, the carriage 74 is arranged with its suction cups 78, 80 above the glass pane 26. At this point in time, work on another glass pane 26 lying on the rotary table 12 has been finished, the rotary table has reached its initial position which coincides with the end position staggered by 360°, and the conveyor track 14 to 24 of the rotary table 12 is in alignment with the feed conveyor 64 and the discharge conveyor 92 which are arranged on the same level as the conveyor track 14 to 24. Simultaneously, the carriage 90 has moved into its end position which, as shown in FIG. 1 on the right-hand side, faces toward the rotary table 12.

The motors 76, 94 are now switched off by the automatic fixed-cycle control and, thus, the conveying rollers 64 and 92 of the feed or discharge conveyors are no longer driven. The suction cups 78, 80 are lowered onto the glass pane 26 which is still to be worked, shown on the left-hand side of FIG. 1, and the suction cups of the carriage 90 are lowered onto the already worked glass pane 26 which is on the rotary table 12. In addition, the peripheral cutting wheels 48, 50 are moved away from the edge of the already worked pane 26 by 10 to 15 mm by means of the piston-cylinder unit 58. The carriages 74, 90 are now moved from the end positions shown on the left of FIG. 1 into the two end positions on the right. This has the result that, simultaneously, the finished glass pane 26 of FIG. 1 still lying on the rotary table slides by means of the carriage 90 onto the discharge conveyor 92 and the glass pane 26, in FIG. 1 lying on the feed conveyor 74, slides onto the conveyor track 14 to 24 of the rotary table 12.

Subsequently, the suction cups 28, 30, 32, 34 are lowered onto the glass pane 26 lying on the rotary table and the suction cups of the feed carriage 74 and the suction cups of the discharge carriage 90 are released. Then, the carriages 74, 90, without having contact with a glass pane, are moved back from the end position reached in this manner and shown on the right-hand side of FIG. 1 into the end position illustrated on the left-hand side of FIG. 1. The feed and discharge conveyors are again actuated by means of the motors 76, 94 in order to deliver a new glass pane and, on the other hand, to make available the finished glass pane lying on the discharge conveyor 92 to further working procedures.

During the movements of the carriages 74, 90 and the actuation of the motors 76, 94, the rotary table 12, after engagement of the peripheral cutting wheels 48, 50 by means of the piston-cylinder unit 58, performs a full rotation by 360° and, thus, the entire edge of the glass pane is chamfered uniformly. This is done in such a manner that the peripheral cutting wheel which comes first into contact with the pane edge to be worked - when the sense of rotation of the rotary table 12 is assumed to be clockwise then this is the peripheral cutting wheel 48 - has an essentially flat peripheral surface. The peripheral cutting wheel 50 may be concave, for example, in the shape of a C. As a result, first, the peripheral cutting wheel 48 cuts the broken edge of the glass pane 26 to be chamfered in order to obtain a flat surface at the periphery. Subsequently, the cutting wheel 50 with the C-shaped periphery is able to uniformly break or chamfer the edges of the glass pane.

The important factor in this connection is that the template guide of the peripheral cutting wheels 48, 50 ensures a completely uniform working of the glass pane 26, including the corners, thus eliminating difficulties in the further working of the pane, particularly the occurrence of hairline fractures during hardening and the like. In addition, disengagement of the peripheral cutting wheels 48, 50 during loading and unloading of the rotary table 12 ensures that the glass pane 26 cannot be damaged during loading and unloading of the rotary table. Of course, before the rotation of the rotary table 12 for cutting begins, the peripheral cutting wheels 48, 50 are once again moved into engagement with the glass pane 26.

A variety of modifications of the above-described embodiment are possible within the scope of the invention. For example, instead of the carriages 74, 90 whose wheels 68, 70 are guided in the U-sections of the track conveyor sections 66, 88, sliding carriages or the like can also be provided. It is also possible to replace the described suction cups 78, 80 of the carriages 74, 90 which serve to grasp the glass panes during loading and unloading by other engagement means, for example, mechanical devices which act on the edge of the pane. The drive of the conveying rollers 64 or 92 can also be disengaged in an advantageous manner so that appropriate couplings are provided between the motors 76, 94 and the respective roller conveyors. In this connection, it is only important to ensure that the rollers run idle while the glass panes are conveyed by means of the carriages 74, 90 or corresponding devices. In addition, it is possible to provide other conveying means instead of the roller conveyors 64, 92, for example, in the form of belts or the like; however, roller conveyors have been proven to be especially effective. The same is true for the feed roller conveyor 14 to 24 of the rotary table 12 which, for example, could also be replaced by a corresponding sliding track.

In summary, the glass cutting machine according to the invention, as a result of the described design and the arrangement in alignment between the feed conveyor and the discharge conveyor, offers the possibility of obtaining a continuous conveying sequence which is only interrupted by the working of the pane edges during the rotation of the rotary table 12. In the last portion of the feed conveyor and the first portion of the discharge conveyor and the peripheral regions of the rotary table 12, a glass pane is conveyed by means of the carriages 74, 90 which serve as charging devices and can be moved above the roller conveyors by means of the rope drive in the track 66, 88 which cantilevers over the rotary table of the glass cutting machine.

As described above, contrary to the known twin edge trimming cutter, as heretofore used for chamfering the edges of glass panes for front and rear windows of motor vehicles, the glass cutting machine according to the invention has, in the manner shown from the German Auslegeschrift No. 2,349,817, template guided peripheral cutting wheels which ensure an exact, uniform working of the glass pane edges to be chamfered even in the corner regions of the pane. Simultaneously, the arrangement of the rotary table between the feed and discharge roller conveyors preferably arranged in alignment relative to each other facilitates a conveying sequence with a maximum throughput whose continuous sequence is only interrupted by the turning of the rotary table which is required for chamfering the glass pane lying on the rotary table at the time. The essential factor in this connection is that the rotary table itself has a conveyor track, preferably also in the form of a roller conveyor, which is in alignment with the feed and discharge conveyors when the latter are in the loading and unloading positions.

As further described above, the invention provides that the template guided peripheral cutting wheels, which are preferably provided as a pair, can be moved away or disengaged from their working positions during loading and unloading by approximately 10 to 15 mm, the working position being the position in which the cutting wheels rest against the template or the edge of the glass pane which is worked or to be worked. As a result, damages to the glass pane are safely eliminated. The use of this possibility of disengagement is not limited to glass cutting machines of the inventive type. On the contrary, this independently inventive arrangement can be used generally in template guided cutting wheels.

While the foregoing description and drawings represent the preferred embodiments of the present invention, it will be obvious to those skilled in the art that various changes and modifications may be made therein without departing from the true spirit and scope of the present invention.

What is claimed is:

1. Apparatus for automatically cutting the edges of generally planar glass panes, comprising:

a generally circular table including a conveyor track for transporting the glass planes in a conveying direction and for providing a substantially horizontal support for the glass panes, said conveyor track extending over substantially the entire diameter of said table between a loading end at which the glass panes are fed onto said track and an unloading end at which the glass panes are discharged from said track, said table being arranged for rotation about a vertical axis which is normal to the surfaces of the glass panes;

means for rotating said table about said vertical axis at a desired rate;

gripping means responsive to rotation of said table for releasably gripping the glass panes on said table to fix the glass panes against movement relative to said table when said table is rotated and the glass panes are cut;

means for cutting the edges of the glass panes to a desired contour as said table is rotated from an initial position to an end position;

a feed conveyor fixed with respect to the rotation axis of said table and arranged to be aligned in said conveying direction with the loading end of said conveyor track when said table is in either of said initial and said end positions for horizontally supporting and delivering the glass panes to the loading end of said conveyor track;

means associated with said feed conveyor for loading the glass panes onto said conveyor track, said loading means including a first feed carriage including at least one suction cup for releasably holding the glass panes;

a first track fixed with respect to the rotation axis of said table and arranged parallel to and above said feed conveyor for guiding said first feed carriage between a first end position whereat said first feed carriage grasps a glass pane to be cut and a second end position whereat said first feed carriage release the glass pane when the glass pane is loaded onto said conveyor track and said gripping means is operated, said first track extending above and parallel to said conveyor track of said table for a distance of about one-third the length of said conveyor track;

a discharge conveyor fixed with respect to the rotation axis of said table and arranged to be aligned in said conveying direction with the unloading end of said conveyor track when said table is in either of said initial and said end positions for horizontally supporting and discharging the glass panes from the unloading end of said conveyor track;

means associated with said discharge conveyor for unloading the glass panes from said conveyor track, said unloading means including a second feed carriage including at least one suction cup for releasably holding the glass panes;

a second track fixed with respect to the rotation axis of said table and arranged parallel to and above said discharge conveyor for guiding said second feed carriage between a first end position whereat said second feed carriage grasps a glass pane which has been cut on said conveyor track when said gripping means releases the cut glass pane, and a second end position whereat said second feed carriage releases the cut glass pane for further processing, said second track extending above and parallel to said conveyor track of said table for a distance of about one-third the length of said conveyor track;

means including a rope drive arrangement for moving said first and said second feed carriages along said first and said second tracks, respectively, in corresponding relationship with rotation of said table so that said feed carriage delivers a first glass pane to be cut to said table while said second feed carriage simultaneously discharges a second, cut glass pane from said table, and said first feed carriage thereafter returns to deliver a third glass pane to be cut to said table while said second feed carriage simultaneously returns to discharge the first, then cut glass pane from said table; and a cantilever support arm extending over said table, wherein said gripping means is mounted to said support arm and includes a number of uniformly distributed, downwardly projecting suction cups.

* * * * *